US006512914B2

(12) United States Patent
Kabashima

(10) Patent No.: US 6,512,914 B2
(45) Date of Patent: Jan. 28, 2003

(54) OPTION FIXING DEVICE

(75) Inventor: Akio Kabashima, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 09/976,151

(22) Filed: Oct. 15, 2001

(65) Prior Publication Data

US 2002/0098022 A1 Jul. 25, 2002

(30) Foreign Application Priority Data

Jan. 23, 2001 (JP) ..... 2001-014893

(51) Int. Cl.[7] ..... G03G 15/20
(52) U.S. Cl. ..... 399/341; 399/68
(58) Field of Search ..... 399/341, 320, 399/328, 329, 68, 110, 122–407; 219/216; 430/124; 347/156

(56) References Cited

U.S. PATENT DOCUMENTS 5,404,200 A * 4/1995 Martin et al. ..... 399/68
5,890,032 A * 3/1999 Aslam et al. ..... 399/341 X
6,272,310 B1 * 8/2001 Blair et al. ..... 399/341
2002/0037176 A1 * 3/2002 Ogino et al. ..... 399/68

FOREIGN PATENT DOCUMENTS

JP A 11-242400 9/1999

* cited by examiner

*Primary Examiner*—Sophia S. Chen
(74) *Attorney, Agent, or Firm*—Oliff & Berridge, PLC

(57) ABSTRACT

An option fixing device which is detachably coupled to an image forming apparatus of the type in which a toner image formed on a surface of a photosensitive member is transferred onto a recording sheet is provided. The option fixing device includes a sheet entrance port, a first sheet transport path which receives a recording sheet coming through the sheet entrance port and discharges the recording sheet without passing the recording sheet through a fixing unit, a second sheet transport path which causes the recording sheet to pass through the fixing unit and then discharges the recording sheet, and the fixing unit for fusing and fixing a toner image on the recording sheet being transported on and along the second sheet transport path.

5 Claims, 9 Drawing Sheets

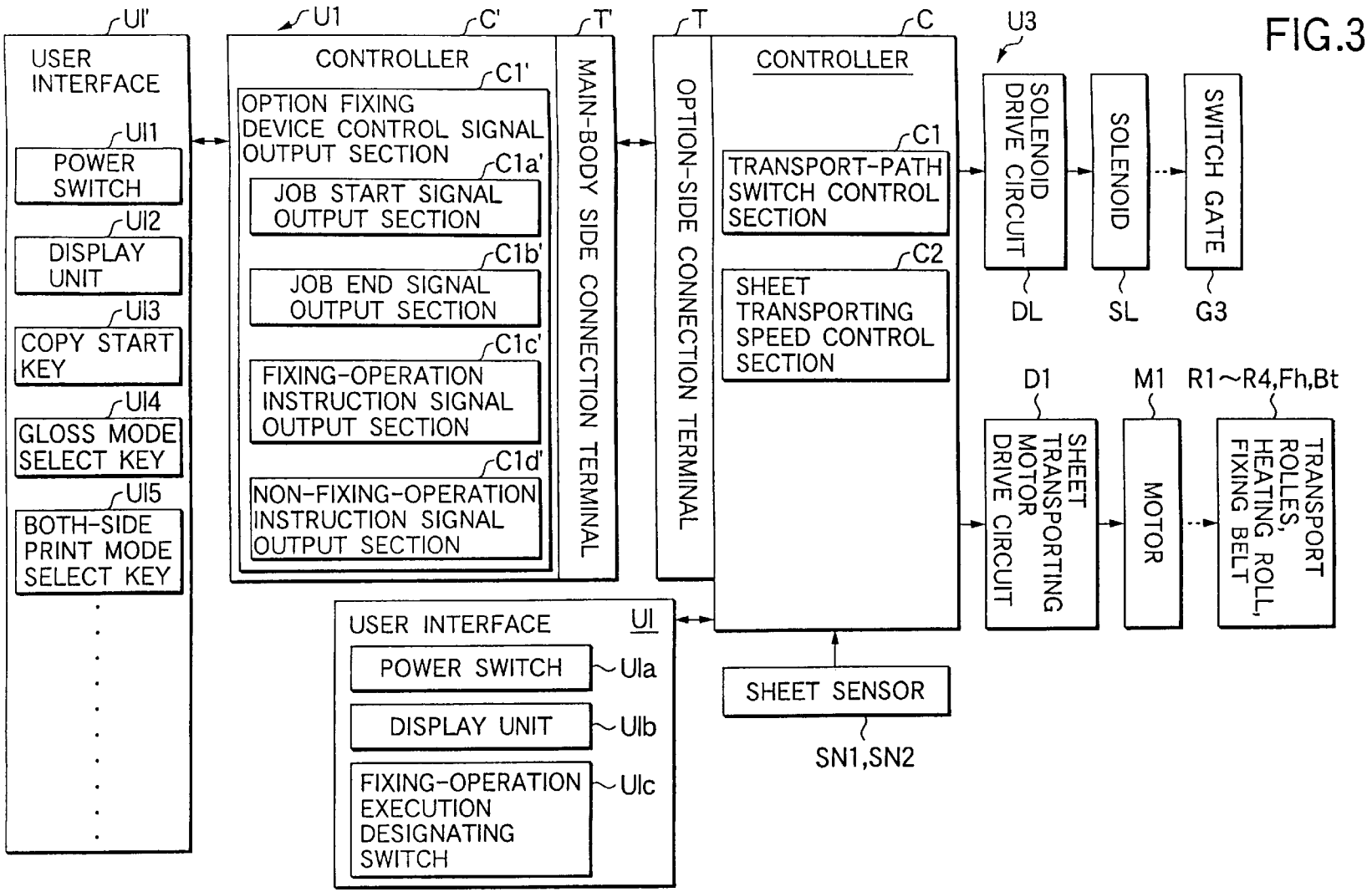
FIG.3
SWITCH GATE
G3
SOLENOID
SL
SOLENOID DRIVE CIRCUIT
DL
U3
TRANSPORT ROLLES, HEATING ROLL, FIXING BELT
R1~R4,Fh,Bt
MOTOR
M1
SHEET TRANSPORTING MOTOR DRIVE CIRCUIT
D1
C
CONTROLLER
C1
TRANSPORT-PATH SWITCH CONTROL SECTION
C2
SHEET TRANSPORTING SPEED CONTROL SECTION
SHEET SENSOR
SN1,SN2
T
OPTION-SIDE CONNECTION TERMINAL
T'
MAIN-BODY SIDE CONNECTION TERMINAL
C'
CONTROLLER
C1'
OPTION FIXING DEVICE CONTROL SIGNAL OUTPUT SECTION
C1a'
JOB START SIGNAL OUTPUT SECTION
C1b'
JOB END SIGNAL OUTPUT SECTION
C1c'
FIXING-OPERATION INSTRUCTION SIGNAL OUTPUT SECTION
C1d'
NON-FIXING-OPERATION INSTRUCTION SIGNAL OUTPUT SECTION
U1
UI
USER INTERFACE
UIa
POWER SWITCH
UIb
DISPLAY UNIT
UIc
FIXING-OPERATION EXECUTION DESIGNATING SWITCH
UI'
USER INTERFACE
UI1
POWER SWITCH
UI2
DISPLAY UNIT
UI3
COPY START KEY
UI4
GLOSS MODE SELECT KEY
UI5
BOTH-SIDE PRINT MODE SELECT KEY FLOW CHART OF AN OPTION FIXING DEVICE CONTROL SIGNAL OUTPUTTING PROCESS IN IMAGE FORMING APPARATUS U1

FIG.5 FLOW CHART OF A SHEET TRANSPORTING CONTROL PROCESS IN OPTION FIXING DEVICE

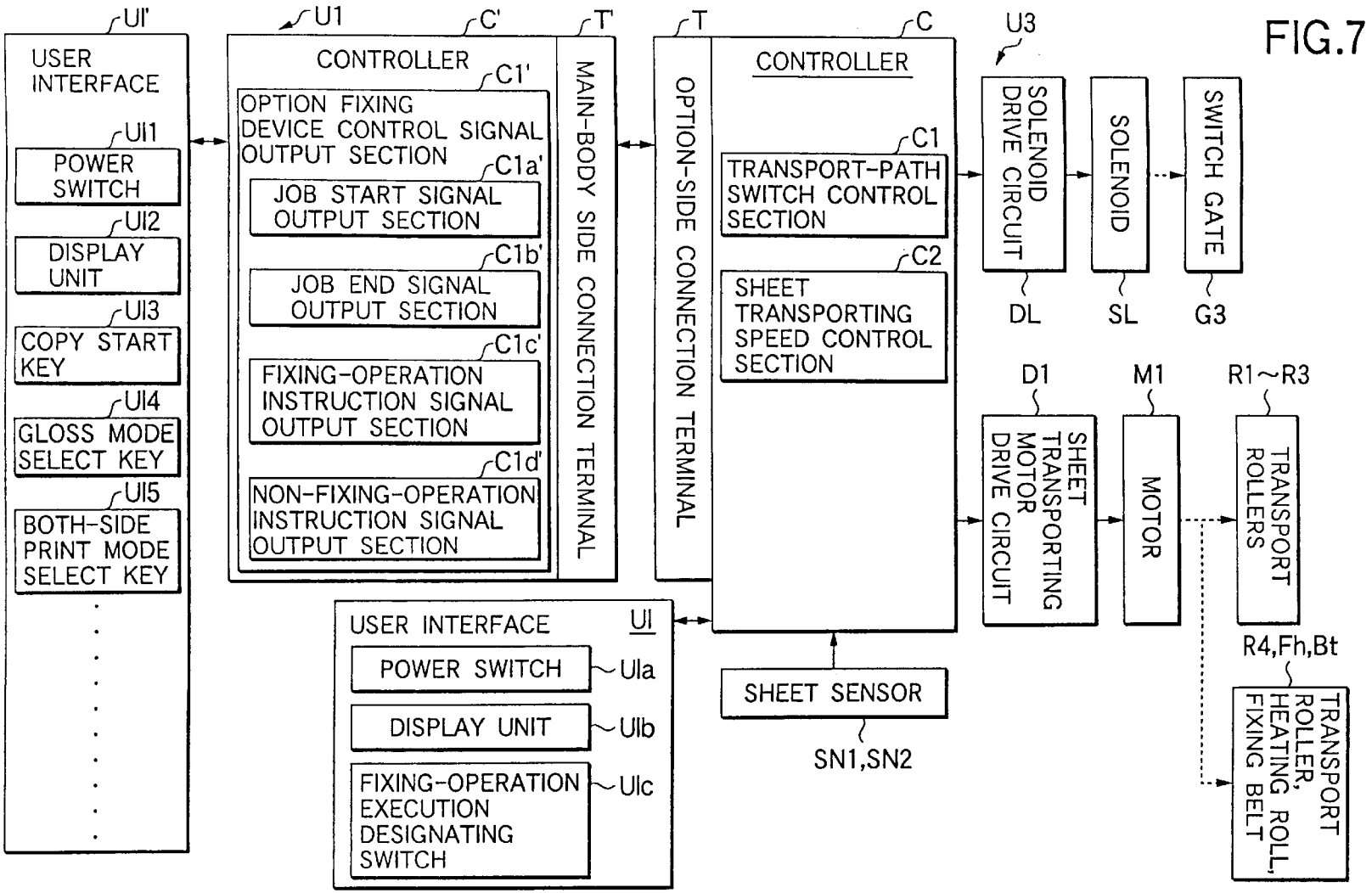
FIG.7
SWITCH GATE
G3
SOLENOID
SL
SOLENOID DRIVE CIRCUIT
DL
U3
R1~R3
TRANSPORT ROLLERS
R4,Fh,Bt
TRANSPORT ROLLER, HEATING ROLL, FIXING BELT
M1
MOTOR
D1
SHEET TRANSPORTING MOTOR DRIVE CIRCUIT
C
CONTROLLER
C1
TRANSPORT-PATH SWITCH CONTROL SECTION
C2
SHEET TRANSPORTING SPEED CONTROL SECTION
SHEET SENSOR
SN1,SN2
T
OPTION-SIDE CONNECTION TERMINAL
T'
MAIN-BODY SIDE CONNECTION TERMINAL
C'
CONTROLLER
C1'
OPTION FIXING DEVICE CONTROL SIGNAL OUTPUT SECTION
C1a'
JOB START SIGNAL OUTPUT SECTION
C1b'
JOB END SIGNAL OUTPUT SECTION
C1c'
FIXING-OPERATION INSTRUCTION SIGNAL OUTPUT SECTION
C1d'
NON-FIXING-OPERATION INSTRUCTION SIGNAL OUTPUT SECTION
U1
USER INTERFACE
U1a
POWER SWITCH
U1b
DISPLAY UNIT
U1c
FIXING-OPERATION EXECUTION DESIGNATING SWITCH
U1'
USER INTERFACE
U11
POWER SWITCH
U12
DISPLAY UNIT
U13
COPY START KEY
U14
GLOSS MODE SELECT KEY
U15
BOTH-SIDE PRINT MODE SELECT KEY FIG.8 FLOW CHART OF A SHEET TRANSPORTING CONTROL PROCESS OF OPTION FIXING DEVICE
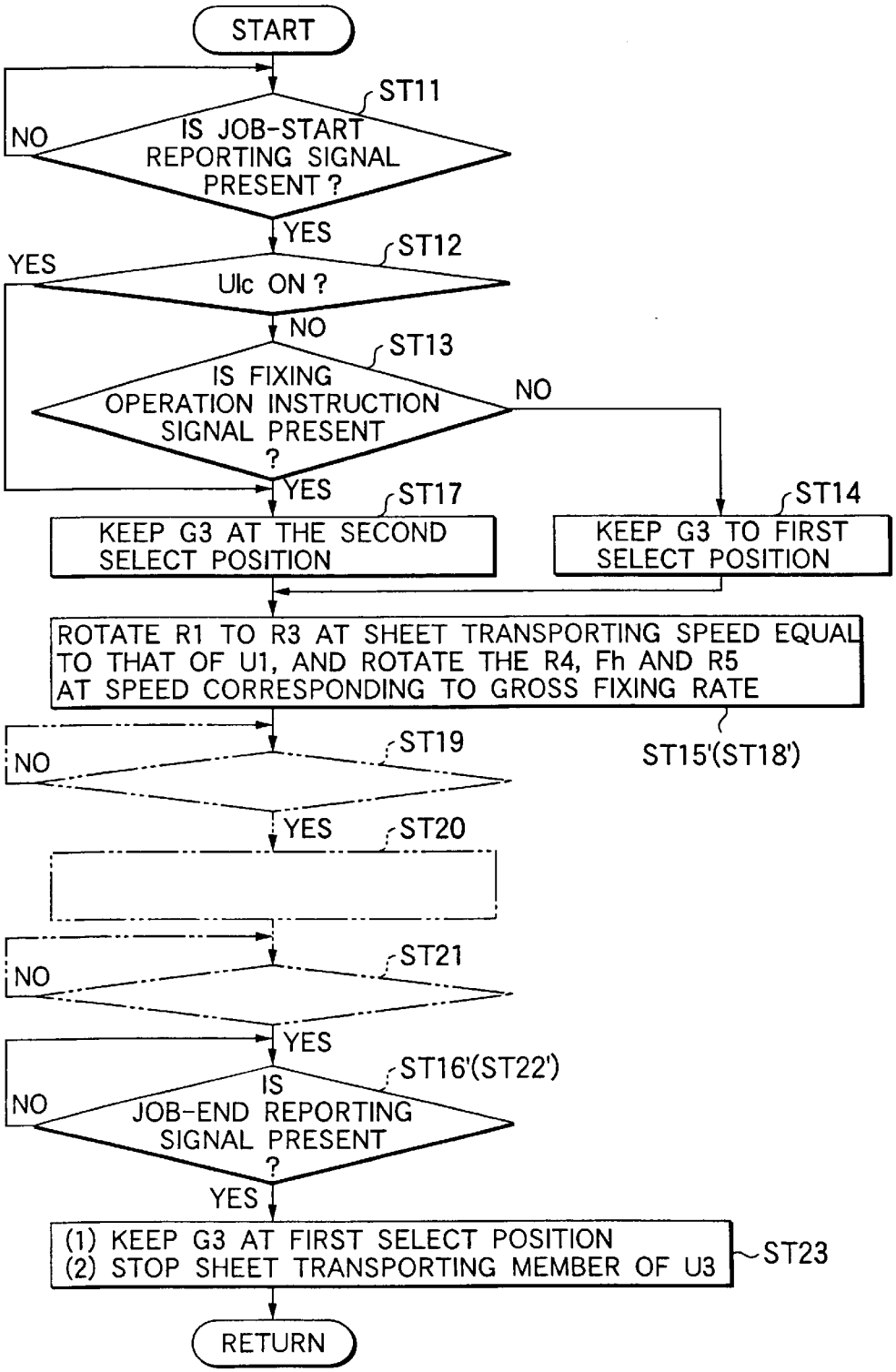

OPTION FIXING DEVICE

BACKGROUND OF THE INVENTION

1. Field of the Invention

The present invention relates to an option fixing device which is coupled with an image forming apparatus, such as a copying machine, a printer and a facsimile machine, and fixes a toner image on a recording sheet discharged from the image forming apparatus.

2. Description of the Related Art

In fixing images of different image qualities, such as a color image and a black monochromatic image, or fixing images on different kinds of recording materials, such a normal paper and OHP, a common practice in an image forming apparatus according to a related art is to change a surface temperature of a heating roll or a rotation speed of fixing rolls (heating and pressing rolls). It is very difficult to change the picture quality, particularly gloss, by one fixing apparatus so as to satisfy a level of user's liking on the picture quality. One of solutions for this difficulty is to use a plurality of fixing devices and to provide fixed images varied in picture quality.

The following technique (J01) has been known for this type of fixing device.

Technique disclosed in (J01) JP-A-11-242400

This publication proposes that a plurality of fixing devices are provided to produce an image of high gloss level, which resembles a photograph image. One of those fixing devices is a belt fixing device. This belt fixing device is detachably attached to the image forming apparatus.

SUMMARY OF THE INVENTION

Problem of the (J01)

In the technique where the plurality of fixing devices are used to increase a variation of picture quality, as in the related art (J01), the image forming apparatus is indispensably provided with a sheet-discharging transport path for transporting a normal recording sheet having undergone the fixing process, a transport path for transporting the normal fixed recording sheet to a second fixing device, and a path selector.

Since the image forming apparatus must be provided with the sheet-discharging transport path for transporting a normal recording sheet having undergone the fixing process, the transport path for transporting the normal fixed recording sheet to a second fixing device, and the path selector, the image forming apparatus is complicated in construction and increased in size, and hence increased in cost.

For the above background reasons, objects of the present invention as follows:

enabling an image forming apparatus incapable of fixing a gloss toner image to form a gloss toner image; and providing an option fixing device which can fix, as desired, a toner image of a recording sheet discharged from the normal sheet discharge port of the image forming apparatus.

Description of the invention, which succeeds in solving the problems mentioned above, will be given hereunder. In the description, constituent elements of the invention will be attached with reference symbols parenthesized for ease of their correspondence to those in the embodiment description to be given later. It should be understood that the reference symbol are used for ease of better understanding of the invention, and the use of them does not limit scope and spirits of the invention.

First aspect of the invention

To achieve the above object, there is provided an option fixing device (U3) according to the first aspect of the invention, comprising:

a sheet entrance port (2*a*) through which a recording sheet (S) is entered;

a discharge port (3*a*, 4*a*; 3*b*) adapted to discharge the recording sheet (S);

first (SH6) and second sheet transport paths (SH7) adapted to transport the recording sheet (S) entered to the discharge port (3*a*, 4*a*; 3*b*);

a transport path switch member (G3) being movable between a first switch position for transporting the recording sheet (S) to the first sheet transport path (SH6) and a second switch position for transporting the recording sheet (S) to the second sheet transport path (SH7);

a fixing unit (F) adapted to heating-fix a toner image on the recording sheet (S) transported through the second sheet transport path (SH7); and a switch member drive member (SL) adapted to move the transport path switch member (G3) to one of the first and second switch positions in accordance with a transport path switch signal, wherein the option fixing device (U3) is detachably coupled to an image forming apparatus (U1) in which the toner image is transferred onto the recording sheet (S), the toner image is fixed onto the recording sheet (S), and the recording sheet (S) is discharged from a sheet discharge port (Ka) of the image forming apparatus; and the recording sheet discharged from the sheet discharge port of the image forming apparatus is entered through the sheet entrance port.

Operation of the option fixing device according to the first aspect of the invention In the option fixing device according to the first aspect of the invention, comprising the above described structure, a recording sheet (S) discharged from the image forming apparatus (U1) is transported to the sheet entrance port (2*a*) in a state where the option fixing device (U3) is coupled to the image forming apparatus (U1). The switch member drive member (SL) drives the path switch member (G3) to the first switch position or the second switch position in accordance with the transport select signal.

The path switch member (G3), when moved to the first switch position, guides the recording sheet (S) entered through the sheet entrance port (2*a*) to the sheet discharge port (4*a*; 3*b*), while not guiding a recording sheet (S) to the fixing unit (F).

The path switch member (G3), when moved to the second switch position, guides the recording sheet (S) entered through the sheet entrance port (2*a*) to the second sheet transport path (SH7). The second sheet transport path (SH7) guides the recording sheet (S) entered through the sheet entrance port (2*a*) to the fixing unit (F), and then to the sheet discharge port (3*a*; 3*b*).

The toner image on the recording sheet transported through the second sheet transport path (SH7) is fixed at a fixing rate appropriately preset. Thus, the resultant toner image has a good gloss.

The option fixing device according to the first aspect of the invention can fix, as desired, the toner image on the recording sheet (S) discharged from the sheet discharge port (Ka), usually used, in the image forming apparatus (U1) Further, the option fixing device according to the first aspect of the invention enables an image forming apparatus incapable of fixing a gloss toner image to form a gloss toner image.

Second aspect of the invention

In the second aspect of the invention, there is provided the option fixing device according to the first aspect of the invention, wherein the fixing unit (F) is a belt type fixing unit having a fixing belt (Bt) adapted to heating-fix the toner image on the recording sheet (S) transported through the second sheet transport path (SH7).

Operation of the option fixing device according to the second aspect of the invention The option fixing device according to the second aspect of the invention comprising the above described structure can produce a toner image with a good gloss because of using the fixing unit (F) having a fixing belt (Bt)

Third aspect of the invention

In the third aspect of the invention, there is provided the option fixing device according to any one of the first and second aspects of the invention, further comprising: a sheet transporting speed control section (C2) adapted to control a sheet transporting speed to change a sheet transport speed at the time the recording sheet (S) passes through the fixing unit (F) of the second sheet transport path (SH7) to a sheet transport speed being slower than a sheet transport speed at the time the recording sheet (S) is entered, the sheet transport speed at the time the recording sheet (S) passes through the fixing unit (F) corresponds to a fixing rate for forming a gloss image.

Operation of the option fixing device according to the third aspect of the invention In the option fixing device (U3) according to the third aspect of the invention comprising the above described structure, the sheet transporting speed control section (C2) controls a sheet transporting speed such that when the recording sheet entered through the sheet entrance port (2*a*) passes through the fixing unit (F) of the second transport path (SH7), the control section (C2) decreases the sheet transporting speed to a speed which is slower than that when the recording sheet (S) is entered to the sheet entrance port (2*a*) so that the sheet transporting speed corresponds to a fixing rate for forming a gloss image. Accordingly, the option fixing device (U3) according to the third aspect of the invention can adjust the sheet transporting speed of the recording sheet (S) entered through the sheet entrance port (2*a*), independently of the sheet transporting speed of the recording sheet (S) passing through the fixing unit (F). Specifically, the option fixing device (U3) according to the third aspect of the invention can set the sheet transporting speed of the recording sheet (S) entered through the sheet entrance port (2*a*) in connection with a sheet discharging speed of the recording sheet (S) discharged from the image forming apparatus (U1) . Accordingly, the image forming apparatus (U1) can control a sheet transporting speed at the time of forming an image, while not taking the sheet transporting speed of the option fixing device (U3) according to the third aspect of the invention into account.

Fourth aspect of the invention

In the fourth aspect of the invention, there is provided the option fixing device (U3) according to any one of the first to third aspect of the invention, wherein a sheet transport distance between an discharge roll (Rh) of the image forming apparatus (U1) and the fixing unit (F) of the second sheet transport path (SH7) is longer than a length of the recording sheet (S) having the maximum size to be used in a transport direction.

Operation of the option fixing device according to the fourth aspect of the invention In the option fixing device (U3) according to the third aspect of the invention comprising the above described structure, after the rear end of the recording sheet (S) passes the discharging roller (Rh), the forward end of the recording sheet (S) reaches a fixing region (Q5) of the fixing unit (F). Accordingly, the sheet transporting speed of the third option fixing device (U3) may controlled in the following way. (1) The sheet transporting speed of the option fixing device (U3) is set to be equal to that of the image forming apparatus (U1) till the rear end of the recording sheet (S) pass through the discharging roller (Rh), and whereby the recording sheet (S) is reliably and smoothly discharged from the image forming apparatus (U1) to the option fixing device (U3). (2) After the rear end of the recording sheet (S) passes through the discharging roller (Rh) and before the forward end of the recording sheet reaches the fixing region (Q5) of the fixing unit (F), the sheet transporting speed is decreased to a sheet transporting speed corresponding to a desired fixing rate.

Fifth aspect of the invention

In the fifth aspect of the invention, there is provided the option fixing device (U3) according to any one of the first to fourth aspects of the invention, further comprising a sheet sensor (SN1) adapted to detect a forward end of the recording sheet (S), disposed near a fixing region (Q5) provided in an upstream side of the fixing unit (F) with respect to a sheet transporting direction.

Operation of the option fixing device according to the fifth aspect of the invention In the option fixing device according to the fifth aspect of the invention comprising the above described structure, the sheet sensor (SN1) detects the forward end of the recording sheet (S) at an upstream position as view ed in the sheet transporting direction before the recording sheet (S) reaches the fixing region (Q5) of the fixing unit (F) . Accordingly, the detection is possible as to whether or not the rear end of the recording sheet (S) passes through the discharging roller (Rh) of the image forming apparatus (U1), on the basis of a detection signal of the recording sheet (S).

After the rear end of the recording sheet (S) passes through the discharging roller (Rh) of the image forming apparatus (U1), the sheet transporting speed in the option fixing device (U3) is decreased to a sheet transporting speed corresponding to a fixing rate at which a gloss image is formed.

BRIEF DESCRIPTION OF THE DRAWINGS

FIG. 3 is a block diagram showing an image forming apparatus and a control section of the option fixing device according to the embodiment 1 coupled to the image forming apparatus.

FIG. 7 is a block diagram showing the option fixing device according to the embodiment 2 of the present invention and a control section of an image forming apparatus coupled to the option fixing device.

FIG. 8 is a flow chart showing a sheet transporting speed control process of the option fixing device according to the embodiment 2. The flow chart corresponds to that shown in FIG. 5 of the embodiment 1.

DETAILED DESCIRPTION OF THE PREFERRED EMBODIMENTS

Embodiment 1

Figure 1:
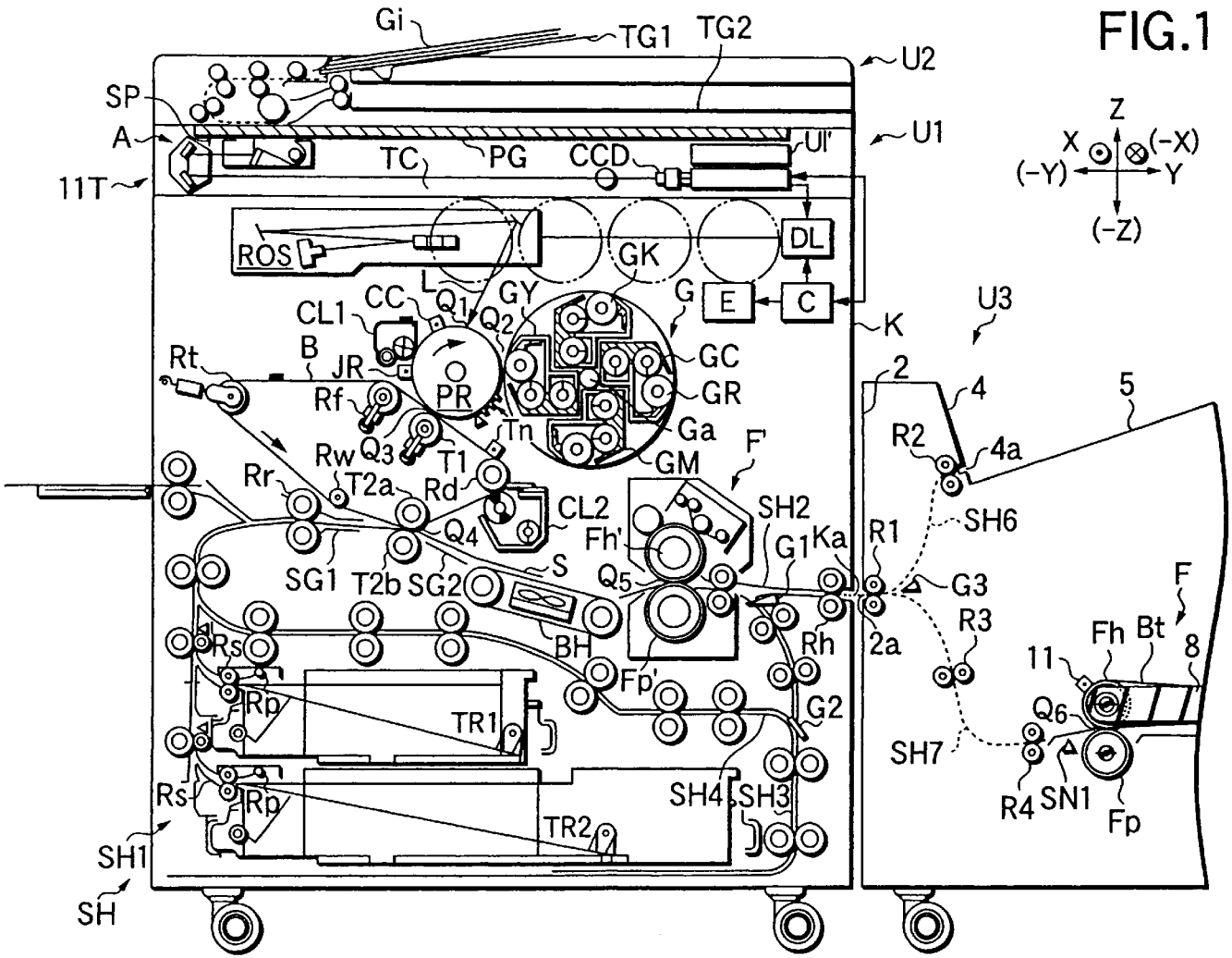
FIG. 1 is an explanatory diagram showing an image forming apparatus to which an option fixing device according to an embodiment 1 of the present invention is coupled.

An option fixing device (U3) according to the embodiment 1 of the present invention is characterized in comprising the following constituent element (A011)

(A011) a sheet discharge port (3*b*) connected to downstream side, in a sheet transporting direction, of a first sheet transport path (SH6) and a second sheet transport path (SH7), the sheet discharge port for discharging recording sheets received from the transport paths (SH6 and SH7).

Operation of the Embodiment 1

In the option fixing device of the embodiment 1 of the invention, a post-processing device (a device for processing (e.g., sorting, binding, and punching) a recording sheet with a fixed toner image) (U4) can be used to be coupled to a sheet discharge port (3*b*) of the option fixing device (U3).

In this case, a recording sheet transported through the first sheet transport path (SH6) of the option fixing device (U3) and a recording sheet transported through the second sheet transport path (SH7) to be undergone a fixing process by a fixing unit (F) can be post-processed.

Embodiment 2

An option fixing device according to the embodiment 2 of the present invention is characterized in, in addition to the embodiment 1, comprising the following constituent element (A012).

(A012) a fixing-execution designating switch (U1*c*) operated in case of designating switching operation of a path select member (G3) to generate a transport-path select signal.

Operation of the embodiment 2

In the thus constructed option fixing device according to the embodiment 2, since the path switch member (G3) can be moved to a predetermined select position in accordance with an input of the fixing-execution designating switch (U1*c*), it can be freely selected whether a recording sheet transported through a sheet entrance port (2*a*) is fixed to be glossy or not. For this reason, even if an image forming apparatus (U1) coupled to the option fixing device (U3) does not have a gloss mode select key (UI4), a glossy toner image can be formed by inputting the fixing-execution designating switch (U1*c*) of the option fixing device (U3).

Embodiment 3

An option fixing device according to the embodiment 3 of the present invention is characterized in, in addition to the embodiment 1 or the embodiment 2, comprising the following constituent elements (A013), (A104).

(A103) an option-side connection terminal (T) connected to a main-body side connection terminal T' of the image forming apparatus (U1) when the option fixing device (U3) is connected to the image forming apparatus (U1), the option-side connection terminal (T) inputted a fixing operation instruction signal from the image forming apparatus (U1)

(A014) a transport-path switch control section (C1) for outputting a transport path select signal when a fixing operation instruction signal is inputted to the option-side connection terminal (T)

Operation of the embodiment 3

In the option fixing device according to the embodiment 3 having the above construction, a recording sheet (S) discharged from the image forming apparatus (U1) is transported to the sheet entrance port (2*a*) in a state where the option fixing device (U3) is coupled to the image forming apparatus (U1) . The option-side connection terminal (T) of the option fixing device (U3) is connected to the main-body side connection terminal (T') of the image forming apparatus (U1) and inputted a fixing operation instruction signal from the image forming apparatus (U1). The transport-path switch control section (C1) outputs a transport path select signal when the fixing operation instruction signal is inputted to the option-side connection terminal (T). At the time of outputting the transport path select signal, the select-member drive member (SL) drive the path switch member (G3) to move to a predetermined select position.

Accordingly, the option fixing device (U3) according to the embodiment 3 can performs desired fixing on a toner image of the recording sheet discharged from the usually used sheet discharge port of the image forming apparatus (U1) . Further, the first option fixing device enables an image forming apparatus incapable of fixing a gloss toner image to form a gloss toner image.

Example

Specific examples of the present invention will be described with reference to the accompanying drawings. However, it should be understood that the present invention is not limited to those preferred embodiments to be described hereunder. For ease of explanation, in the drawings, the front and back directions are represented by X directions; the right and left directions, by Y directions; and the up and down directions, by Z directions. The directions or sides indicated by arrows denoted as X, −X, Y, −Y, Z, −Z will be forward, rearward, to left, to right, upward, and downward, or front side, rear side, left side, right side, upper side, and lower side.

○ containing a dot "●" therein indicates a direction being directed from the rear side of a drawing sheet to the obverse side. ○ containing a mark "X" therein indicates a direction being directed from the obverse side to the reverse side.

Embodiment 1

FIG. 1 is an explanatory diagram showing an image forming apparatus to which an option fixing device according to an embodiment 1.

Figure 2:
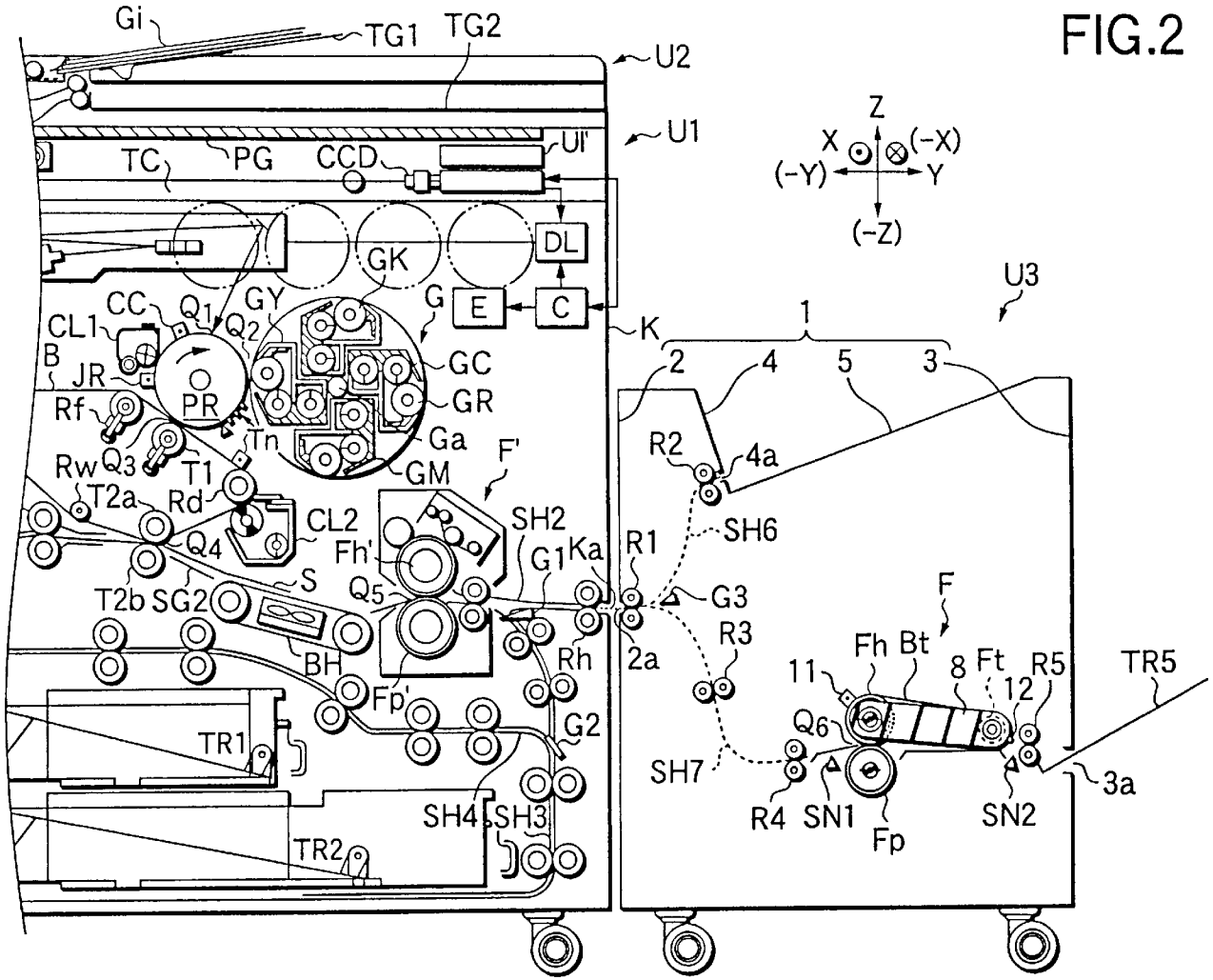
FIG. 2 is an explanatory diagram showing the option fixing device according to the embodiment 1 of the present invention coupled to the image forming apparatus.

FIG. 2 is an explanatory diagram showing the option fixing device according to the embodiment 1 of the present invention is coupled to the image forming apparatus.

FIG. 3 is a block diagram showing the image forming apparatus and a control section according to the embodiment 1 of the option fixing device coupled to the image forming apparatus.

In FIGS. 1 and 2, an automatic document feeder U2 is placed on a platen glass PG located on the upper end of an image forming apparatus U1 constructed by a copying machine.

The automatic document feeder U2 includes a sheet supply tray TG1 in which a stack of original documents Gi to be copied is placed. Those original documents Gi that are put in the sheet supply tray TG1 successively pass a copying position on a platen glass PG, and are discharged into a sheet discharge tray TG2. The automatic document feeder U2 can be turned with respect to the image forming apparatus U1 by means of a hinge shaft (not shown), which is provided at the rear end (−X end) thereof while horizontally extending. The automatic document feeder U2 is turned upward when an operator puts an original document Gi on the platen glass PG by hand.

The image forming apparatus U1 includes a UI' (user interface) used when the user enters operation command signals, e.g., a copystart. In FIG. 3, the user interface UI' includes a power switch UI1, a display unit UI2, a copy start key UI3, a gloss mode select key (a key inputted when recording an image in a gloss mode) UI4, a both-side print mode select key (a key inputted when selecting a both-side print mode) UI5, a number-of-copies set key (not shown), ten keys, and others. The display unit UI2 displays information in relation to current setting status of the image forming apparatus U1.

A document reader IIT is located under the transparent platen glass PG on the upper surface of the image forming apparatus U1. The document reader IIT includes an exposure register sensor (platen register sensor) SP located at a platen register position (OPT position) and an exposure optical system A.

The exposure optical system A is controlled in its movement and stop in accordance with a detect signal of the exposure register sensor SP, and is normally standstill at a home position. Light that reflected from the original document Gi that passes an exposure position on the upper surface of the platen glass PG by the automatic document feeder U2 or an original document placed on the platen glass PG by hand is, through the exposure optical system A, converted into electrical signals of r (red), g (green) and b (blue) by a CCD (solid state image pickup device).

An image processing system converts the electrical signals of r, g and b received from the CCD into image data of k (black), y (yellow), m (magenta), and c (cyan), and temporarily store them therein. Then, the image processing system outputs the image data as image data for forming latent images to a laser drive circuit DL at predetermined timings.

The laser drive circuit DL outputs a laser drive signal to a ROS (latent image forming unit) in accordance with the inputted image data.

An image carrying member PR constructed with a photosensitive drum rotates in a direction of an arrow. The image carrying member PR is discharged by a charge remover JR; uniformly charged by a charger cc; and is scanned with a laser beam L emitted from the latent image forming unit ROS at a latent image writing position Q1, and whereby an electrostatic latent image is formed. To form a full-color image, electrostatic latent images corresponding to k (black), y (yellow), m (magenta) and c (cyan) are successively formed. To form a monocolor image, only an electrostatic latent image corresponding to k (black) is formed.

The surface of the image carrying member PR which carries the electrostatic latent image thereon rotates to pass a developing part Q2 and a primary transfer part Q3 successively.

A developing device G of the rotary type includes developing units GK, GY, GM and GC of four colors, k (black), y (yellow), m (magenta) and c (cyan), which are successively rotated toward the developing part Q2 with the rotation of a rotary shaft Ga. The developing units GK, GY, GM and GC are provided with developing rolls GR for transporting developers to the developing part Q2, respectively. Those developing units develop electrostatic latent images on the image carrying member PR passing the developing part Q2.

New toners are supplied from toner cartridges TC (referring to FIGS. 1 and 2) to the developing units GK, GY, GM and GC, respectively.

Disposed under the image carrying member PR are a plurality of belt support rolls (Rd, Rt, Rw, Rf, T2*a*) including an intermediate transfer belt B, a belt drive roll Rd, a tension roll Rt, a walking roll Rw, an idler roll (free roll) Rf, and a backup roll T2*a*, and further a primary transfer roll T1, and a belt frame (not shown) supporting them. The intermediate transfer belt B is rotatably and movably supported by the belt support rolls (Rd, Rt, Rw, Rf, T2*a*).

In case of forming a full-color image, an electrostatic latent image of a first color is formed at the latent image writing position Q1 to form a toner image Tn of the first color at the developing part Q2. The toner image Tn is electrostatically primarily-transferred onto the intermediate transfer belt B by means of the primary transfer roll T1 when passing through the primary transfer part Q3. Subsequently, toner images Tn of second, third and fourth colors are successively primarily-transferred, in a superimposing manner, onto the intermediate transfer belt B carrying the toner image Tn of the first color. Finally, a full-color superimposed toner image is formed on the intermediate transfer belt B.

In case of forming a monocolor image, one developing unit is used for the developing process, and a monocolor image is primarily transferred onto the intermediate transfer belt B.

After the primary transferring process, on the surface of the image carrying member PR, residual toner is discharged by the charge remover JR, and then the surface is cleaned by an image carrying member cleaner CL1.

A secondary transfer roll T2*b* is disposed under the backup roll T2*a* to be movable between a position where the secondary transfer roll T2*b* is apart from the backup roll T2*a*and a position where the secondary transfer roll T2*b* is in contact with the backup roll T2*a*. A contact part where the backup roll T2*a* is in contact with the secondary transfer roll T2*b* forms a secondary transfer part Q4.

A secondary transfer voltage which is opposite in polarity to the charged toner used by the developing device G is supplied from a power source circuit E (FIGS. 1 and 2) to the backup roll T2*a*. The power source circuit E is controlled by a controller C.

Recording sheets S contained in a paper feed trays TR1 or TR2 are picked up by a pickup roll Rp at a predetermined timing, and separated sheet by sheet by a sheet separating roll Rs, and transported to a register roll Rr by means of a plurality of transporting rolls Ra.

The recording sheet S transported to the register roll Rr is transferred from a before-transfer sheet guide SG1 to the secondary transfer part Q4 in synchronism with the transportation of the primarily transferred superimposed toner image or the monocolor image to the secondary transfer part Q4.

In the secondary transfer part Q4, the secondary transfer unit T2 electrostatically secondarily-transfers the toner image from the intermediate transfer belt B to the recording sheet S. Residual toner is removed from the intermediate transfer belt B undergone the secondary transfer by a belt cleaner CL2.

The secondary transfer roll T2*b* and the belt cleaner CL2 are disposed to come in contact with and to separated from (detaching and contacting) the intermediate transfer belt B. When a color image is formed, those rolls are separated from the intermediate transfer belt B until a toner image of the final color, which is not yet fixed, is primarily transferred onto the intermediate transfer belt B. The secondary transfer roll cleaner moves to come in contact with and to separate from the intermediate transfer belt B, together with the secondary transfer roll T2*b*.

The recording sheet S having the secondarily transferred toner image is transferred to a fixing part Q5 by means of an after-transfer sheet guide SG2 and a sheet transfer belt BH. The fixing part Q5 is a part (nip) where a heating roll Fh' of a fixing unit F' is in pressing contact with a pressing roll Fp'. The recording sheet S passing through the fixing part Q5 is fixed by the fixing unit F'. The heating roll Fh' is constructed such that a heat-resistance elastic layer made of heat-resistance rubber is layered over a surface of a metal pipe made of SUS or the like, and has, for example, a heater of 600W in inside thereof. The surface of the heating roll Fh' is heated to about 160°. The pressing roll Fp' is constructed such that a release resin layer is formed over a surface of a metal pipe made of SUS or the like. A sheet-releasing oil is applied to the outer peripheral surface of the heating roll Fh' at a position located upstream of the fixing part Q5 as viewed in the rotation direction, by an oil coating device. A cleaning device for cleaning the surface of the heating roll Fh' is disposed at a position which is around the heating roll Fh' and the pressing roll Fp' and downstream of the fixing part Q5 as viewed in the rotational direction to be in contact with the surface of the heating roll Fh'.

The recording sheet S whose toner image is fixed is transferred through a sheet discharge path SH2 located under the fixing part Q5 to the discharging roller Rh, and discharged outside from a sheet discharge port Ka formed in the side wall of the image forming apparatus U1.

A sheet reversing path SH3 is coupled to the sheet discharge path SH2 at a position located upstream of the discharging roller Rh and a select gate G1 is provided at the connection part therebetween. The select gate G1 selectively guides the recording sheet S transported through the sheet discharge path SH2 to the discharging roller Rh or the sheet reversing path SH3.

A sheet circulating path SH4 is coupled to the sheet reversing path SH3, and a select gate G2 is provided at the connection part therebetween. The select gate G2 allows a recording sheet transported through the sheet reversing path SH3 from the select gate G1 to pass therethrough, and directs a recording sheet passed therethrough once and switched back thereto, to the sheet circulating path SH4. The recording sheet transported to the sheet circulating path SH4 passes through the sheet feeding path SH1 and returned to the transfer part Q4. The components SH1 to SH4 form a sheet transport path SH. Those components Rp, Rs, Rr, Ra, SG1, SG2, and BH form the sheet transport path SH.

Option fixing device

As shown in FIG. 2, the option fixing device U3 coupled to the image forming apparatus U1 includes a case 1. A sheet entrance port 2*a* is formed in a left wall 2 in alignment with the sheet discharge port Ka of the image forming apparatus U1. An entrance roller R1 is provided at the sheet entrance port 2*a*. A sheet discharge port 3*a* is formed in a right wall 3 of the case 1. A sheet discharge wall 4 having a sheet discharge port 4*a* and an upper sheet discharge tray 5 are provided on the upper surface of the case 1.

A recording sheet transported from the sheet entrance port 2*a* of the left wall 2 is selectively transported to the first sheet transport path SH6 or the second sheet transport path SH7 by a transport roller R1 and the switch gate (transport switch gate) G3. The switch gate G3 is operated by a solenoid (select-member drive member, see FIG. 3) SL.

The first sheet transport path SH6 is coupled to the sheet discharge port 4*a* of the sheet discharge wall 4, and a sheet discharge roller R2 is provided on the inner side of the sheet discharge port 4*a*. Transport rollers R3 and R4, a fixing unit F, and a discharge roller R5 are disposed in the second sheet transport path SH7 to be arranged in this order from the upstream side to the downstream side. The discharge roller R5 is coupled to the inner side of the sheet discharge port 3*a* of the right wall 3 to discharge the recording sheet transported through the second sheet transport path SH7 to a sheet discharge tray TR5, from the sheet discharge port 3*a*.

The belt type fixing unit F includes a heating roll Fh and a pressing roll Fp. The heating roll Fh is constructed such that a heat-resistance elastic layer made of heat resistance rubber is layered over a surface of a metal pipe and a heater is disposed therein. The pressing roll Fp, like the heating roll Fh, is constructed such that a release resin layer is formed over a surface of a metal pipe and a heater is disposed therein.

A tension roll Ft is rotatably supported at a free end of a fixing belt support frame 8, which is rotatably supported on a shaft of the heating roll Fh. A fixing belt Bt is wound on the heating roll Fh and the tension roll Ft. A fixing part Q6 is formed by a press contact part (nip) between the fixing belt Bt and the pressing roll Fp. A sheet guide 9 is provided downstream of the fixing part Q6 as viewed in the sheet transfer direction.

The heating roll Fh is rotated by a motor M1 (FIG. 3) and the fixing belt Bt is rotated with the rotation of the heating roll Fh.

A cleaner 11 for cleaning the surface of the fixing belt Bt is disposed at a position which is located upstream of the fixing part Q6 as viewed in the moving direction of the fixing belt Bt and in proximity to the outer peripheral surface of the fixing belt Bt supported by the heating roll Fh. A separation pawl 12 is provided proximate to a part of the outer peripheral surface of the fixing belt Bt where the fixing belt Bt is supported on the tension roll Ft. A tip of the separation pawl 12 is brought into contact with the surface of the fixing belt Bt to separate the recording sheet S from the fixing belt Bt.

A sheet sensor SN1 is provided on the second sheet transport path SH7 at a position located upstream of the belt type fixing unit F and a sheet sensor SN2 is provided at a position located downstream of the belt type fixing unit F.

A distance between the discharging roller Rh of the image forming apparatus U1 and the sheet sensor SN1 is set to be longer than a length of a recording sheet of the maximum size to be used. That is, a length of sheet transport path between the discharging roller Rh of the image forming apparatus U1 and the sheet sensor SN1 is set to be longer than the length of the recording sheet of the maximum size to be used. Therefore, when the sheet sensor SN1 detects a forward end of the recording sheet, a rear end of the recording sheet has passed the discharging roller Rh of the image forming apparatus U1.

For this reason, even if a sheet transporting speed of sheet transporting member (transport roller R1, sheet discharge roller R2, transport roller R3, transport roller R4, discharge roller R5, heating roll Fh and fixing belt Bt) is set at a speed equal to a rotational speed of the discharging roller Rh of the image forming apparatus U1 till the sheet sensor SN1 detects the forward end of the recording sheet and the sheet transporting speed of the sheet transporting member (R1, R2, R3, R4, R5, Fh and Bt) is changed to another value of the speed after the sheet sensor SN1 detects the forward end of the recording sheet, the operation of the image forming apparatus U1 is not affected by the speed change.

Therefore, after the sheet sensor SN1 detects the forward end of the recording sheet, the sheet transporting speed of the sheet transporting member (R1, R2, R3, R4, R5, Fh and Bt) is changed to a sheet transport speed suitable in correspondence with a gloss fixing rate (fixing rate suitable for obtaining a glossy image), and whereby a glossy image can be produced without affecting the operation of the image forming apparatus U1.

Description of the control section according to the embodiment 1

FIG. 3 is a block diagram showing an option fixing device according to the embodiment 1 of the present invention and a control section of an image forming apparatus to which the option fixing device is coupled.

In FIG. 3, the image forming apparatus U1 includes a controller C' and a main-body side connection terminal T'. The option fixing device includes a controller C and an option-side connection terminal T. Each of the controllers C' and C have a computer including an I/O (input/output interface) inputting/outputting a signal to/from outside and adjusting a level of an inputted/outputted signal, a ROM (read only memory) storing programs for executing necessary processes, data and the like, a RAM (random access memory) for temporarily storing necessary data, a CPU (central processing unit) for executing processes in correspondence with programs stored in the ROM, a clock oscillator, and the like. The controller can realize various functions by executing programs stored in the ROM.

The main-body side connection terminal T' and the option-side connection terminal T are interconnected by a connection cable having removal connection terminals.

Signal input elements connected to the controller C'

Signals outputted from the user interface UI', detection signals of various sensors, such as temperature sensor, are inputted to the controller C'.

Controlled elements connected to the controller C'

Controlled elements such as Drive circuits (not shown) of drive motors for driving the image carrying member PR, the intermediate transfer belt B, the developing rolls of the developing units Gy, Gm, Gc, Gk, the heating roll Fh' of the fixing unit F', and the like, transfer power sources (not shown) of the primary transfer roll T1 and the secondary transfer roll T2, and the like are connected to the controller C'. The controller C' outputs control signals for those controlled elements.

Functions of the controller C'

The controller C' have functions for executing processes in accordance with signals from the signal input elements (keys UI3 to UI5 of the user interface UI') to output control signals to the controlled elements. The controller C' according to this embodiment includes a section C1' for realizing the following functions.

Option fixing device control signal output section Cl'

This section C1' includes the following sections C1*a'* to C1*d'*.

Job start signal output section C1*a'*

When a copy start key UI3 of the image forming apparatus U1 is turned on, this section C1*a'* reports a job start to the option fixing device U3.

Job end signal output section C1*b'*

When the job ends, the execution of which is started after the copy start key UI3 of the image forming apparatus U1 is turned on, the job end signal output section C1*b'* reports a job end to the option fixing device U3.

Fixing-operation instruction signal output section C1*c'*

When a gloss mode select key UI4 of the user interface UI' of the image forming apparatus U1 is inputted, the fixing-operation instruction signal output section C1*c'* outputs a fixing operation instruction signal (signal for instructing execution of a fixing operation) to the option fixing device U3 at the time of a job start.

Non-fixing-operation instruction signal output section C1*d'*

When the gloss mode select key UI4 of the user interface UI' of the image forming apparatus U1 is not inputted, the option fixing device control signal output section C1' outputs to the option fixing device U3 a non-fixing-operation instruction signal (signal for instructing non-execution of the fixing operation) at the time of a job start.

If necessary, the non-fixing-operation instruction signal output section C1*d'* may be omitted. In this case, the non-fixing-operation instruction signal is not output. Also in this case, the fixing operation is prohibited in an initial setting of the option fixing device U3. Only when the fixing-operation instruction signal output section C1*c'* outputs the fixing operation instruction signal (the signal for instructing the execution of the fixing operation), the option fixing device U3 performs the fixing operation. In other cases, no fixing operation is performed.

Signal input elements coupled to the controller C

The option fixing device U3 comprises a user interface UI. The user interface UI includes a power switch UIa, a display device UIb, and a fixing-operation execution designating switch UIc. The user interface UI and the controller C' of the image forming apparatus U1 are connected to the controller C of the option fixing device U3.

When the fixing-operation execution designating switch UIc is inputted, the inputted signal is inputted to the controller C.

When the gloss select key UI4 of the user interface UI' of the image forming apparatus U1 is inputted, an option fixing device control signal is inputted from the controller C' to the controller C.

Controlled elements connected to the controller C

The controller C is connected to a solenoid drive circuit DL, a sheet transporting motor drive circuit D1, and the like, and outputs drive signals to those circuits.

Solenoid drive circuit DL:

The solenoid drive circuit DL drives the solenoid SL to move the switch gate G3 between a first switch position (a position where the recording sheet is transported to the first sheet transport path SH6) and a second switch position (a position where the recording sheet is transported to the belt type fixing unit F of the second sheet transport path SH7).

Sheet transporting motor drive circuit D1:

The sheet transporting motor drive circuit D1 drives a motor M1 to rotate the transport roller R1, sheet discharge roller R2, transport roller R3, transport roller R4, discharge roller R5, heating roll Fh', and fixing belt Bt.

Functions of the controller C

The controller C has functions for executing processes in correspondence with input signals from the signal input elements (the controller C' of the image forming apparatus U1 and the fixing-operation execution designating switch UIc) to output control signals to the controlled elements (the solenoid drive circuit DL and the sheet transporting motor drive circuit D1).

In other words, the controller C has the following functions.

Cl: transport-path switch control section

The transport-path switch control section C1 outputs a control signal to the solenoid drive circuit DL in accordance with a signal from the controller C' inputted a signal from the copy start key UI3 or a signal from the fixing-operation execution designating switch UIc to switch the switch gate G3 from the first switch position to the second switch position (the sheet is transported to the belt type fixing unit F).

C2: sheet transporting speed control section

The sheet transporting speed control section C2 outputs a control signal to the sheet transporting motor drive circuit D1 in accordance with an option fixing device control signal from the controller C' to drive the motor M1 and to rotate the sheet transport member (the transport roller R1, the sheet discharge roller R2, the transport roller R3, the transport roller R4, the discharge roller R5, the heating roll Fh and the fixing belt Bt).

When the fixing operation of the belt type fixing unit F is not performed, the sheet transport member (R1, R2, R3, R4, R5, Fh and Bt) rotates at the sheet transporting speed equal to the sheet transporting speed (peripheral speed) of the heating roll Fh of the image forming apparatus U1 and the discharging roller Rh. When the fixing operation by the belt type fixing unit F is performed, the sheet transport member rotates at a predetermined sheet transporting speed for fixing operation.

Operation of the embodiment 1

In the option fixing device according to the embodiment 1 of the present invention comprising the above described construction, the main-body side connection terminal T' is electrically connected to the option-side connection terminal T in a state where the option fixing device U3 is coupled to the image forming apparatus U1.

(1) In case of normal mode (non-gloss mode)

When the gloss mode select key UI4 of the user interface UI' of the image forming apparatus U1 is not inputted, the controller C' operates the image forming apparatus U1 at a image forming speed set for the normal mode (non-gloss mode) to performs image record (transporting the recording sheet ) and simultaneously the option fixing device control signals (the job-start reporting signal, the job-end reporting signal, the non-fixing-operation instruction signal) to the controller C. These signals are sent from the controller C' to the controller C via the cable interconnecting the main-body side connection terminal T' and the option-side connection terminal T.

In the present embodiment, the normal mode is set in the initial setting mode. Therefore, when the gloss mode select key UI4 of the user interface UI' of the image forming apparatus U1 is not inputted, the controller C' of the image forming apparatus U1 and the controller C of the option fixing device U3 transports the recording sheet at a sheet transporting speed corresponding to the normal mode (the non-gloss mode).

At this time, the switch gate G3 is kept at the first select position at which the switch gate G3 is initially set (a position at which the recording sheet is discharged from the first sheet transport path SH6 to the upper sheet discharge tray 5). Accordingly, the recording sheet transported from the sheet discharge port Ka of the image forming apparatus U1 to the sheet entrance port 2*a* is discharged into the upper sheet discharge tray 5. At this time, the controller C of the option fixing device U3 rotates the sheet transport member (the transport roller R1, the sheet discharge roller R2, the transport roller R3, the transport roller R4, the discharge roller RS, the heating roll Fh, and the fixing belt Bt) in the option fixing device U3 at the peripheral speed equal to that of the heating roll Fh' and the discharging roller Rh in the image forming apparatus U1.

(2) In case of gloss mode

When the gloss mode select key UI4 of the user interface UI' of the image forming apparatus U1 is inputted, the controller C' of the image forming apparatus U1 operates the image forming apparatus at a image forming speed set for the gloss mode to perform the image record (transporting the recording sheet) and simultaneously outputs the option fixing device control signals (the job-start reporting signal, the job-end reporting signal, the fixing-operation instruction signal) to the controller C. These signals are sent from the controller C' to the controller C via the cable interconnecting the main-body side connection terminal T' and the option-side connection terminal T.

At this time, the controller C of the option fixing device U3 drives the solenoid drive circuit DL by the transport-path switch control section C1 to switch the switch gate G3 to the second select position (at which the recording sheet is transported from the second sheet transport path SH7 to the belt type fixing unit F), and at the same time, rotates the sheet transport member (R1, R2, R3, R4, R5, Fh and Bt) in the option fixing device U3 at the sheet transporting speed, which is equal to that in the image forming apparatus U1.

When the rear end of the recording sheet transported into the option fixing device U3 passes the discharging roller Rh of the image forming apparatus U1 so that the forward end of the recording sheet is detected by the sheet sensor SN1 located upstream of the belt type fixing unit F, the controller C changes the rotational speed of the sheet transport member (R1, R2, R3, R4, R5, Fh and Bt) to a rotational speed suitable for the gloss fixing.

The recording sheet passing through the fixing part Q6 moves along the sheet guide 9 located downstream of the fixing part Q6 in a state where the toner image is fixed to the recording sheet and the recording sheet closely contacts with the fixing belt Bt. At this time, the toner image on the recording sheet S is fixed and cooled, and then the sheet is separated by the separation pawl 12. Accordingly, a glossy toner image is obtained.

In case of using the option fixing device U3 according to the embodiment 1, there is no need of providing the sheet transport path for transporting the recording sheet S to the option fixing device U3, the path switch member and the like in the image forming apparatus U1. Further, there is no need of changing the process speed in the image forming apparatus U1. Accordingly, the image forming apparatus U1 is free from size and cost increase.

Even if the image forming apparatus U1 coupled to the option fixing device U3 does not have the gloss mode select key UI4 and the function of the fixing-operation instruction signal output section C1*c'*, the fixing-execution designation switch UIc of the user interface UI of the fixing option device U3 is inputted and whereby the option fixing device U3 of the embodiment 1 operates the same as receiving the fixing operation instruction signal from the fixing-operation instruction signal output section C1*c'* of the user interface UI of the option fixing device U3. Accordingly, the option fixing device U3 of the embodiment 1 can also be used to be coupled to the image forming apparatus U1, which does not have the gloss mode select key UI4 and the function of the fixing-operation instruction signal output section C1*c'*.

In the embodiment 1, there is no need of changing the sheet transfer control of the image forming apparatus U1 to which the option fixing device U3 is coupled in accordance with whether the option fixing device U3 is coupled thereto or not.

Flow charts for the embodiment 1

Figure 4:
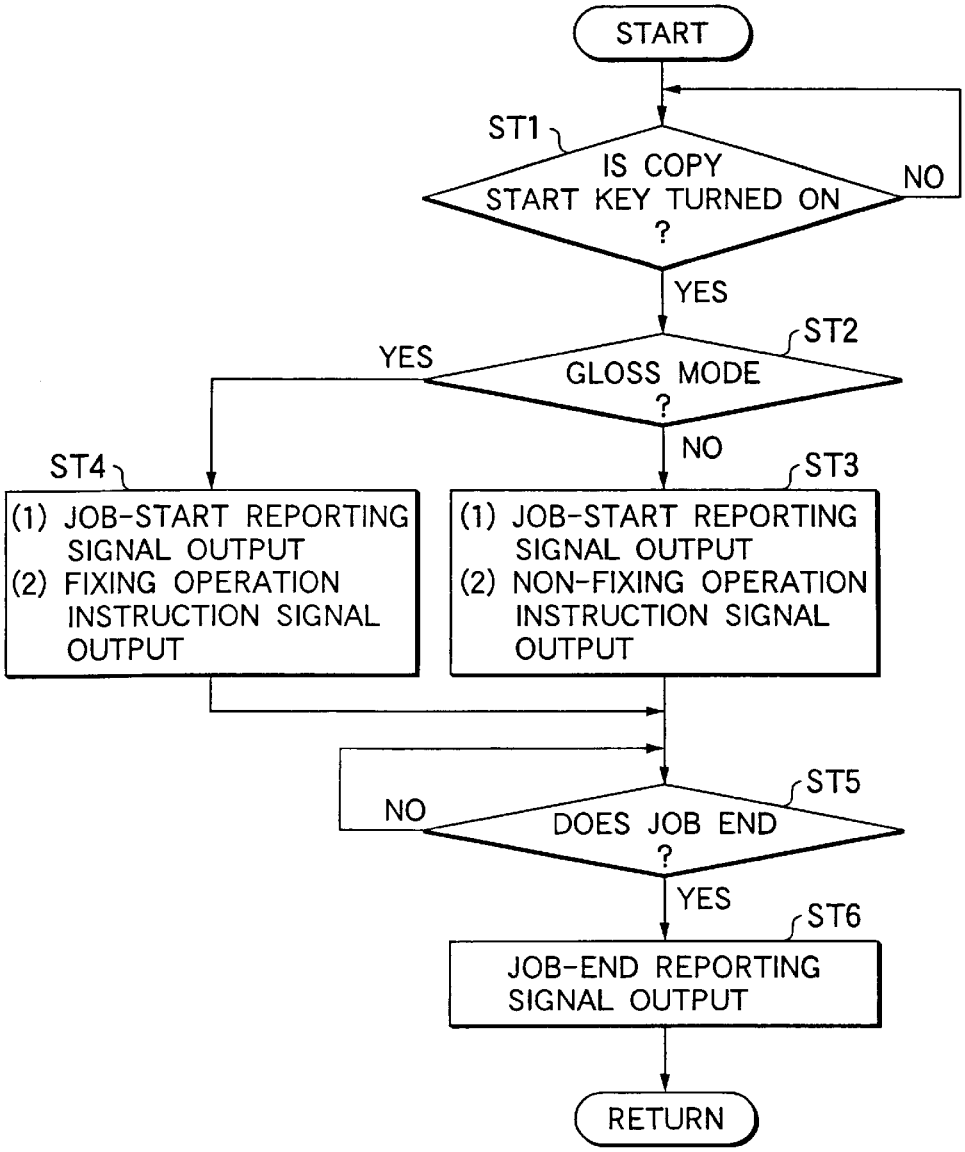
FIG. 4 is a flow chart showing an option fixing device control signal outputting process in the image forming apparatus U1 according to the embodiment 1.

FIG. 4 is a flow chart showing an option fixing device control signal outputting process of the image forming apparatus U1 according to the embodiment 1.

The process of each of steps in the flow chart of FIG. 4 are sequentially executed in accordance with a program stored in the ROM of the controller C'. The process shown in FIG. 4 starts by turning on the power source and is executed in parallel with various other processes in the option fixing device U3 in a multi-task fashion.

In an ST1 (step 1) in FIG. 4, it is determined whether the copy start key is turned on or not. If the determination is NO, the ST1 is repeated in execution. If the determination to the ST1 is YES, the process advances to a ST2.

In ST2, it is determined whether a gloss mode is selected or not. This determines based on whether or not the gloss mode select key UI4 of the controller C' is inputted. If the determination is NO, the current mode is not the gloss mode and then, a normal image recording is performed. The process advances to a ST3.

The ST3 executes the following processes:

(1) to output the job-start reporting signal to the option fixing device U3

(2) to output the non-fixing-operation signal (a signal instructing not to execute the fixing operation) to the option fixing device U3.

If the determination to the ST2 is YES, the process proceeds to a ST4.

The ST4 executes the following processes:

(1) to output the job-start reporting signal to the option fixing device U3

(2) to output the fixing operation instruction signal (a signal instructing the execution of the fixing operation) to the option fixing device U3.

Following ST3 or ST4, an ST5 is executed.

In the ST5, it is determined whether or not the job ends. If the determination is NO, the ST5 is repeated. If the determination is YES, the process advances to a ST6.

In the ST6, the job-end reporting signal is output to the option fixing device U3.

Then, the process returns to the ST1.

Figure 5:
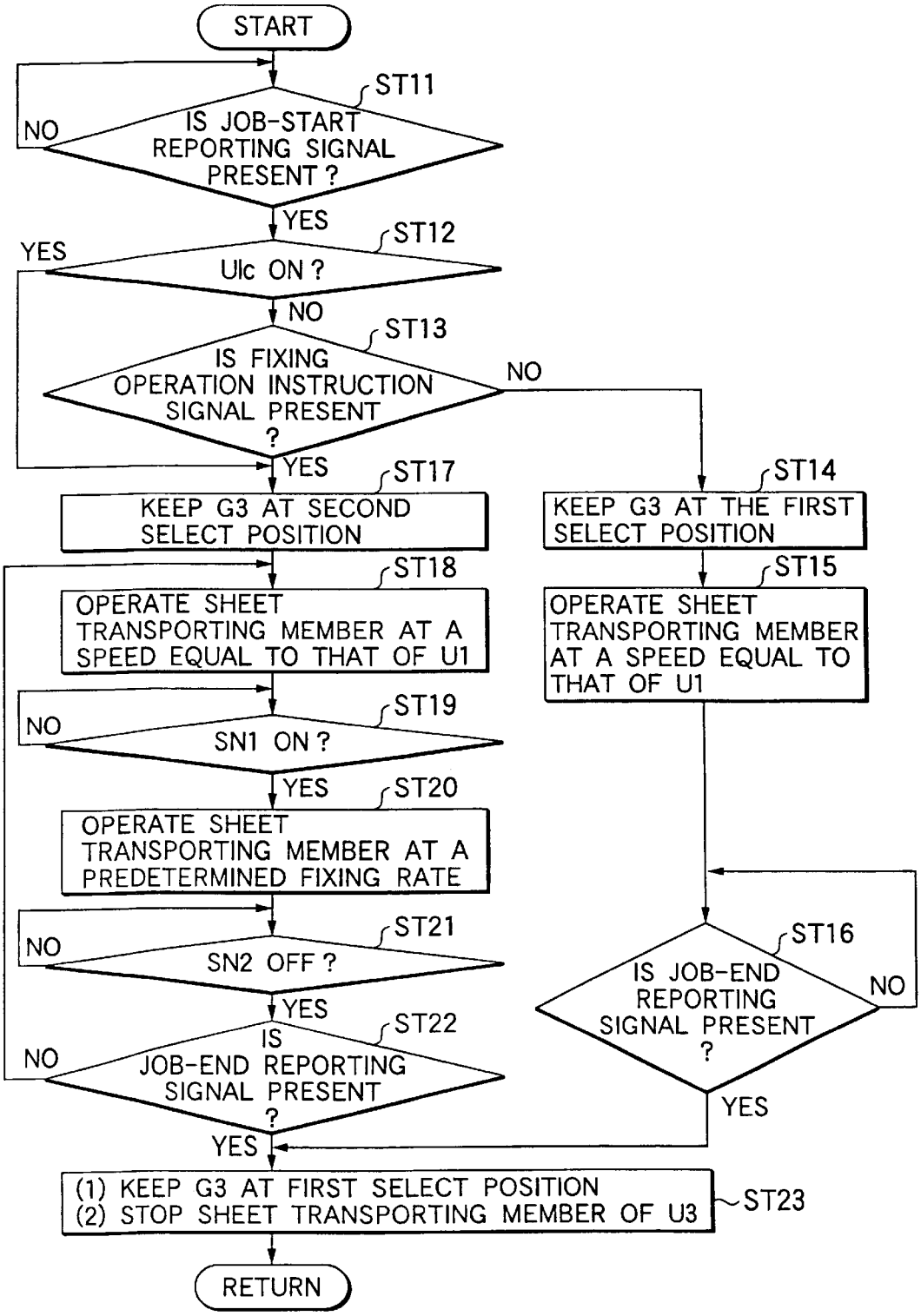
FIG. 5 is a flow chart showing a sheet transporting speed control process in the option fixing device. This process starts in execution upon power on of the option fixing device U3.

FIG. 5 is a flow chart showing a sheet transporting speed control process in the option fixing device.

In an ST11, it is determined whether or not the option fixing device is inputted the job-start reporting signal from the image forming apparatus U1. If the determination is NO, the ST11 is repeated. If the determination is YES, the process advances to an ST12.

In the ST12, it is determined whether or not the fixing-operation execution designating switch UIc of the user interface UI of the option fixing device U3 is inputted. If the determination is NO, the process goes to an ST13.

In the ST13, it is determined whether or not the option fixing device is inputted the fixing operation instruction signal from the image forming apparatus U1.

If the determination is NO, the process advances to an ST14.

In the ST14, the switch gate G3 is kept at the first switch position.

Then, in an ST15, the sheet transport member (transport rollers R1 to R5 and fixing belt Bt) of the option fixing device U3 is operated at a sheet transporting speed equal to the sheet discharging speed of the image forming apparatus U1.

Then, in an ST16, it is determined whether or not the job-end reporting signal is inputted. If the determination is No, the ST16 is repeated in its execution. If the determination is YES, an ST22 is then executed.

If the determination in the ST12 is YES or the determination in the ST13 is YES, the process goes to an ST17.

In the ST17, the switch gate G3 of the option fixing device U3 is kept at the second switch position. Then, the process advances to an ST18.

In the ST18, the sheet transport member (transport rollers R1 to R5 and fixing belt Bt) of the option fixing device U3 is operated at a sheet transporting speed equal to the sheet discharging speed of the image forming apparatus U1. The process advances to an ST19.

In the ST19, it is determined whether or not the sheet sensor SN1 is turned on. If the determination is NO, the ST19 is repeated.

If the determination is YES in the ST19, the process advances to an ST20.

In the ST20, the sheet transport member (the transport rollers R1 to R5 and the fixing belt Bt) of the option fixing device U3 is operated at a predetermined fixing rate (fixing rate at which a glossy image is produced). The process advances to an ST21.

In an ST21, it is determined whether or not the sheet sensor SN2 is turned on. If the determination is No, the ST21 is repeated. If the determination is YES, the process advances to an ST22.

In the ST22, it is determined whether or not the job-end reporting signal is inputted. If the determination is NO, the process returns to the ST18. If the determination is YES in the ST22, the process advances to an ST23.

In the ST23, the following processes are executed:

(1) to keep the switch gate G3 at the first switch position (2) to stop the sheet transport member (the transport rollers R1 to R5 and the fixing belt Bt) of the option fixing device U3

Then, the process returns to the ST11.

Embodiment 2

Figure 6:
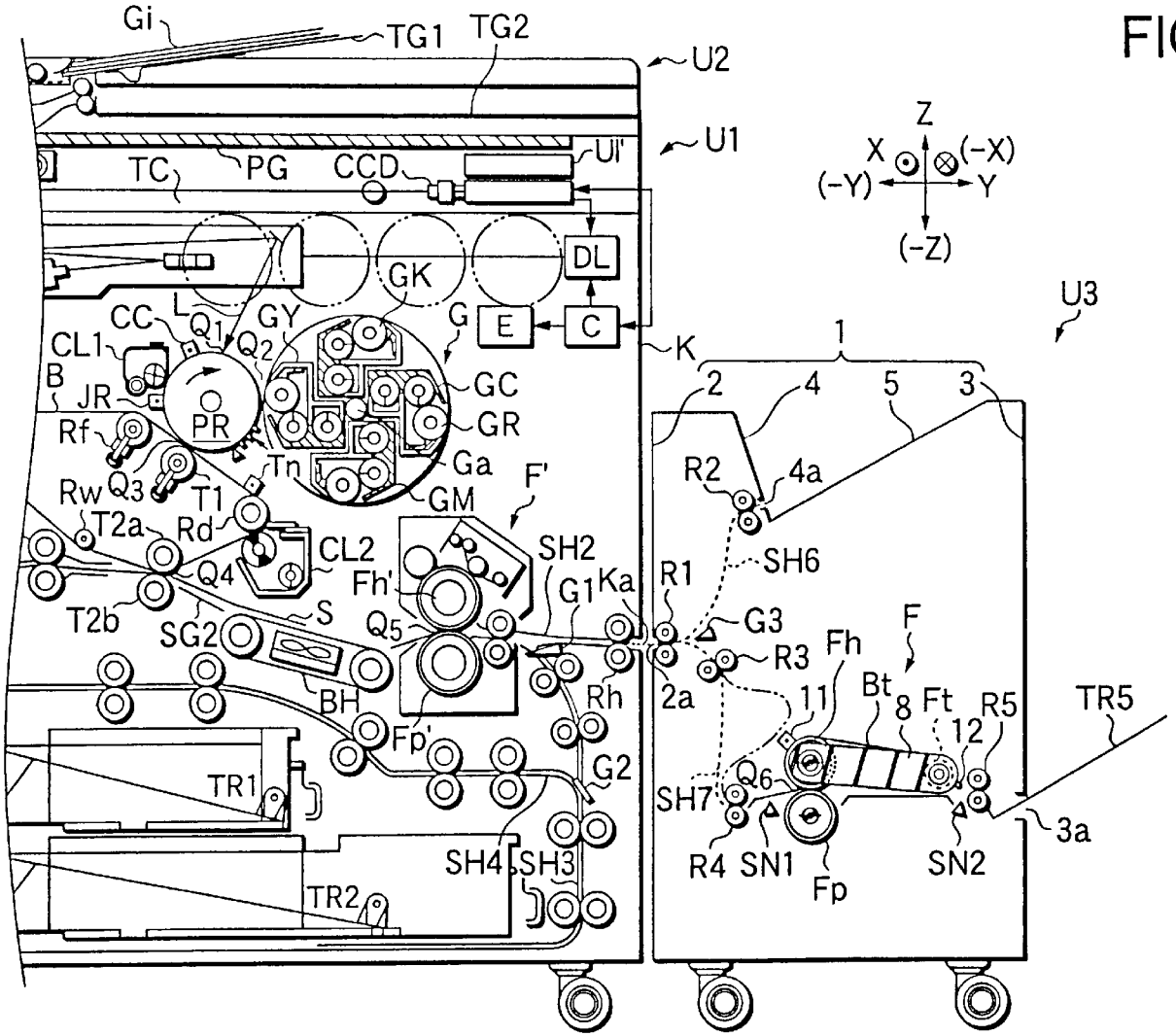
FIG. 6 is a diagram showing an option fixing device coupled to an image forming apparatus according to an embodiment 2 of the present invention. The diagram corresponds to that of FIG. 2 of the embodiment 1.

FIG. 6 is a explanatory diagram showing an option fixing device according to the embodiment 2 coupled to an image forming apparatus. The diagram corresponds to that of FIG. 2 of the embodiment 1.

FIG. 7 is a block diagram showing the option fixing device according to the embodiment 2 of the present invention and a control section of the image forming apparatus coupled to the option fixing device.

In the description of the embodiment 2, a constituent component corresponding to a constituent component of the embodiment 1 is allotted the same reference numeral as that of the embodiment 1 and detail description thereto is omitted.

The embodiment 2 is different from the embodiment 1 in the following points, while the remaining points are substantially the same as those of the embodiment 1.

In FIG. 6, in the option fixing device U3 according to the embodiment 2, a distance of the sheet transport path between the discharging roller Rh of the image forming apparatus U1 and the belt type fixing unit F is set to be shorter than a length of the maximum size recording sheet.

In FIG. 7, a sheet transporting speed (peripheral speed) of the transport roller R1, the sheet discharge roller R2 and the sheet transport roller R3, which are driven by the motor M1, is set to be equal to that of the discharging roller Rh of the image forming apparatus U1. However, a sheet transporting speed (peripheral speed) of the transport roller R4, the heating roll Fh and the fixing belt Bt is reduced to be set lower than the sheet transporting speed of the gloss fixing rate (sheet transporting speed for the gloss fixing and lower than the sheet transporting speed of the discharging roller Rh of the image forming apparatus U1).

In the embodiment 2, the sheet sensors SN1 and SN2 are used only for detecting paper jamming, but not used for controlling the sheet transporting speed.

Description of a flow chart of the embodiment 2

A sheet transporting process of the image forming apparatus U1 in the embodiment 2 is substantially the same as that of the embodiment 1 shown in FIG. 4.

FIG. 8 is a flow chart showing a sheet transporting speed control process of the option fixing device according to the embodiment 2. The flow chart corresponds to that shown in FIG. 5 of the embodiment 1. The process shown in FIG. 8 starts upon power on of the option fixing device U3.

In FIG. 8, ST15' (ST18') is used in place of the ST15 and ST18 of the embodiment 1 shown in FIG. 5 and ST16' (T22') is used in place of the ST16 and ST22. The ST19 to ST21 in the embodiment 1 shown in FIG. 5 are omitted.

In FIG. 8, if the determination is YES in ST11 (in case of inputting the job-start reporting signal from the image forming apparatus U1), the process advances to the ST12. If the fixing-operation execution designating switch UIc is not in an on state in the ST12 and the fixing operation instruction signal is not inputted in the ST13, the process advances to the ST14 to keep the switch gate G3 at the first switch position. In the ST15' (ST18'), the sheet transport member (R1, R2, R3, R4, R5, Fh and Bt) is driven. At this time, the sheet transport member (R1, R2, and R3) are driven at a speed equal to the sheet transporting speed of the discharging roller Rh of the image forming apparatus U1. The sheet transport member (R4, R5, Fh and Bt) is driven at a speed corresponding to the gloss fixing rate (lower than that of the sheet transport member (R1, R2, and R3)).

Accordingly, the recording sheet transported into the option fixing device U3 forms a loop (as indicated by a chain double-dashed line) between the transport rollers R3 and R4, as shown in FIG. 6.

In the embodiment 2, the sheet transport path of the option fixing device U3 can be formed shorter than that in the embodiment 1. Thus, size reduction of the option fixing device U3 can be realized. There is no need of changing sheet transporting speed in the option fixing device U3 during the sheet transporting, while it must be changed in the embodiment 1. Therefore, the control of the sheet transport member is simplified.

There is provided a space to form a loop between the transport roller R3 and the transport roller R4 of the second sheet transport path SH7, and whereby the width of the option fixing device U3 as viewed in the transporting direction can be reduced.

Embodiment 3

Figure 9:
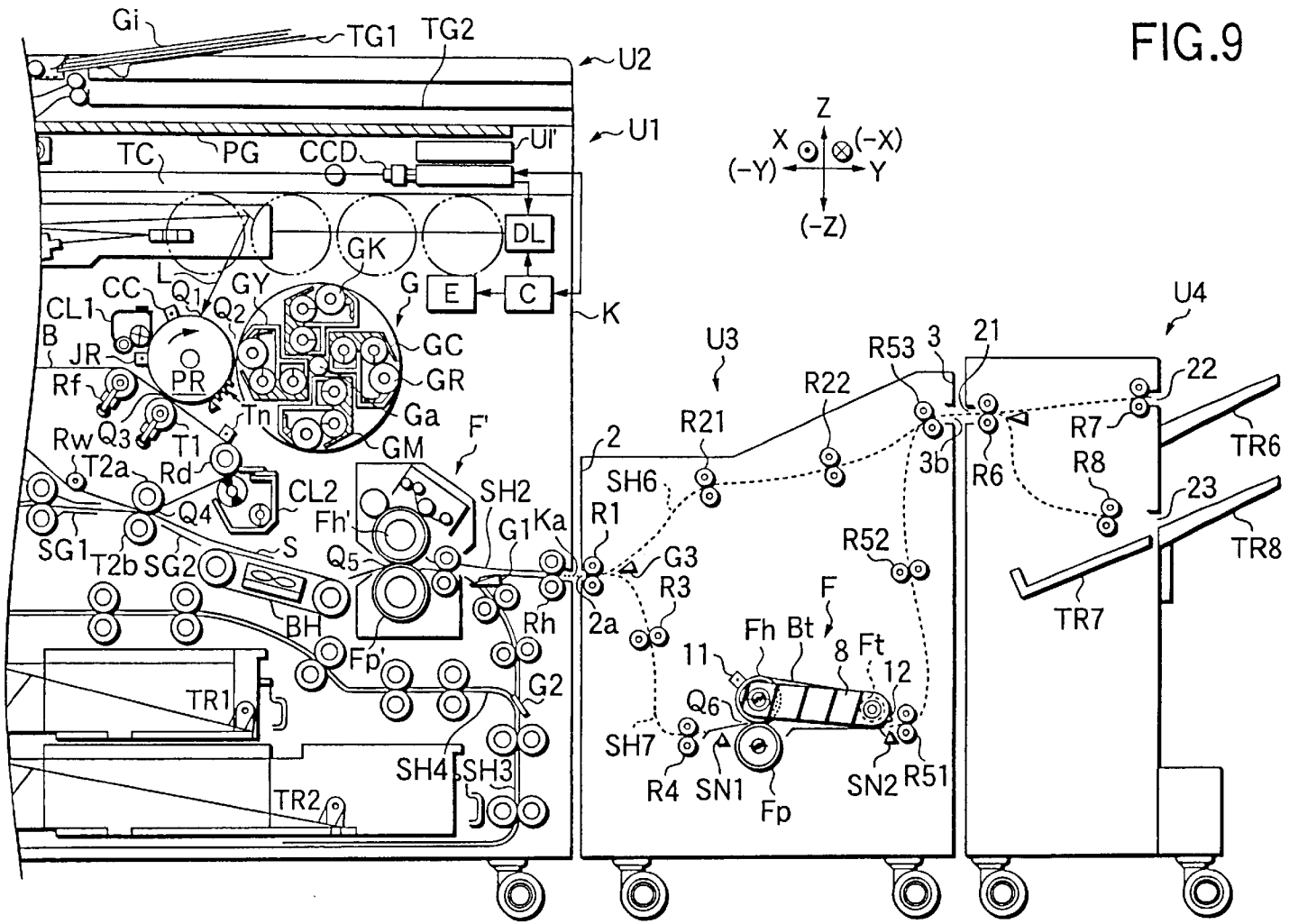
FIG. 9 is a diagram showing a state where an option fixing device according to an embodiment 3 of the present invention is coupled to a post-processing device.

FIG. 9 is a explanatory diagram showing an option fixing device according to the embodiment 3 of the present invention, which is coupled to a post-processing device.

In the description of the embodiment 3, a constituent component corresponding to a constituent component of the embodiment 1 is allotted the same reference numeral as that of the embodiment 1 and detail description thereto is omitted.

The embodiment 3 is different from the embodiment 1 in the following points, while the remaining points are substantially the same as those of the embodiment 1.

In the option fixing device U3, a sheet discharge port 3*b* is formed in the upper part of the right wall 3 of the case 1. The second sheet transport path SH7 is provided between a position located downstream of the belt type fixing unit F as viewed in the sheet transporting direction and the sheet discharge port 3*b*. Transport rollers R51 and R52 and a sheet discharge roller R53 are arranged in the second sheet transport path SH7.

A first sheet transport path SH6 is provided between the switch gate G3 and the sheet discharge roller R53. Transport rollers R21 and R22 are arranged along the first sheet transport path SH6.

A sheet transport distance for transporting the sheet S between the discharging roller Rh of the image forming apparatus U1 and the fixing part Q6 of the belt type fixing unit F is longer than the length of the maximum size recording sheet S to be used.

As shown in FIG. 9, a post-processing device U4 is coupled to the option fixing device U3. A recording sheet transported from the image forming apparatus U1 into the option fixing device U3 passes through the first sheet transport path SH6 or passes through the second sheet transport path SH7 to be fixed at a gloss fixing rate and discharged into the post-processing device U4.

The post-processing device U4 includes a stapler, a punching machine, or the like. A sheet entrance port 21 and sheet discharge ports 22 and 23 are formed in the outer wall of the post-processing device U4. In case of not performing the post-process, the recording sheet transported from the sheet entrance port 21 is discharged into a sheet discharge tray TR6 through the sheet discharge port 22 by a transport roller R6 and a discharge roller R7. In case of performing the post-process, the recording sheet is discharged into a compile tray TR7 by the transport roller R6 and a discharge roller R8. In the compile tray TR7, the sheets are bound with the stapler to be discharged into a sheet discharge tray TR8.

Operation of the embodiment 3

In the option fixing device according to the embodiment 3 of the invention, comprising the above described structure, operates like the option fixing device U3 according to the embodiment 1. However, the recording sheet transported into the option fixing device U3 is discharged into the post-processing device U4 from the same sheet discharge port 3*b* in any cases that the recording sheet passes through the first sheet transport path SH6 and that the recording sheet passes through the second sheet transport path SH7.

In the post-processing device U4, the recording sheets can be post-processed (e.g., bound with the stapler or punched with the punching machine).

Modifications

It should be understood that the present invention is not limited to the above-mentioned embodiments, but may variously be modified, altered and changed within the true spirits of the invention. Some modifications of the invention will be given.

(H01) In the embodiment 2 (FIGS. 6 to 8), in the ST15' shown in FIG. 8, the sheet transport member (R1, R2, and R3) is driven at the speed being equal to the sheet transporting speed of the discharging roller Rh of the image forming apparatus U1, while the sheet transport member (R4, R5, Fh and Bt) is driven at the speed being lower than that of the sheet transport member (R1, R2, and R3). However, the sheet transporting control may be modified such that the sheet transport member (R4, R5, Fh and Bt) is driven at the speed being equal to that of the sheet transport member (R1, R2, and R3) till the recording sheet is transported to a predetermined position proximate to the belt type fixing unit (F) and when the recording sheet reaches the predetermined position, the former speed may be reduced. The sheet transport member (R4, R5, Fh and Bt) may be stopped till the recording sheet is transported to the predetermined position proximate to the belt type fixing unit (F).

(H02) In the belt type fixing device used for forming a gloss image, a coated sheet of paper whose one side is coated is frequently used as the recording sheet S. When images are formed on both sides of the one-side coated sheet, specifically when a monocolor image is formed on one side of the sheet, and a multi-color image is formed on the other side, a monocolor toner image is fixed on the not coated side of the paper sheet by the fixing unit F' of the image forming apparatus U1, and a multi-color toner image is fixed on the coated side. Then, the multi-color toner image on the coated side is fixed by the belt type fixing unit F of the option fixing device U3, and thereby applying a gloss to an image required the gloss.

(H03) In each of above described embodiments, a sheet sensor may be provided inside the sheet entrance port of the option fixing device U3 and a job start switch and a job end switch maybe provided on the user interface UI. Whereby, if the image forming apparatus U1 coupled to the option fixing device U3 does not have the option fixing device control signal output section Cl', a glossy image can be formed.

(H04) The invention may be applied to image forming apparatuses other than the image forming apparatus of the rotary type.

The present invention has the following advantageous effects (E01) to (E03)

(E01) The image forming apparatus, which is incapable of fixing a gloss toner image, can form a glossy toner image.

(E02) There can be provided an option fixing device capable of fixing, as desired, a toner image on a recording sheet discharged through a sheet discharge port, usually used, of the image forming apparatus.

(E03) There can be provided an option fixing device in which there is no need of changing the sheet transporting control of an image forming apparatus coupled to the option fixing device in accrodance with whether or not the option fixing device is coupled.

What is claimed is:

1. An option fixing device comprising:

a sheet entrance port through which a recording sheet is entered;

a discharge port adapted to discharge the recording sheet;

first and second sheet transport paths adapted to transport the recording sheet entered to the discharge port;

a transport path switch member being movable between a first switch position for transporting the recording sheet to the first sheet transport path and a second switch position for transporting the recording sheet to the second sheet transport path;

a fixing unit adapted to heating-fix a toner image on the recording sheet transported through the second sheet transport path; and a switch member drive member adapted to move the transport path switch member to one of the first and second switch positions in accordance with a transport path switch signal, wherein the option fixing device is detachably coupled to an image forming apparatus in which the toner image is transferred onto the recording sheet, the toner image is fixed onto the recording sheet, and the recording sheet is discharged from a sheet discharge port of the image forming apparatus; and the recording sheet discharged from the sheet discharge port of the image forming apparatus is entered through the sheet entrance port.

2. The option fixing device according to claim 1, wherein the fixing unit is a belt type fixing unit having a fixing belt adapted to heating-fix the toner image on the recording sheet transported through the second sheet transport path.

3. The option fixing device according to claim 1, further comprising a sheet transporting speed control section adapted to control a sheet transporting speed to change a sheet transport speed at the time the recording sheet passes through the fixing unit of the second sheet transport path to a sheet transport speed being slower than a sheet transport speed at the time the recording sheet is entered, the sheet transport speed at the time the recording sheet passes through the fixing unit corresponds to a fixing rate for forming a gloss image.

4. The option fixing device according to claim 1, wherein a sheet transport distance between an discharge roll of the image forming apparatus and the fixing unit of the second sheet transport path is longer than a length of the recording sheet having the maximum size to be used in a transport direction.

5. The option fixing device according to claim 1, further comprising a sheet sensor adapted to detect a forward end of the recording sheet, disposed near a fixing region provided in an upstream side of the fixing unit with respect to a sheet transporting direction.

* * * * *